US009151147B2

(12) United States Patent
Clark et al.

(10) Patent No.: US 9,151,147 B2
(45) Date of Patent: Oct. 6, 2015

(54) METHOD AND APPARATUS FOR HYDRAULIC FRACTURING

(75) Inventors: Cory Clark, Sherwood Park (CA); Terry Powers, Edmonton (CA)

(73) Assignee: Stelford Energy, Inc., Airdrie, Alberta (CA)

( * ) Notice: Subject to any disclaimer, the term of this patent is extended or adjusted under 35 U.S.C. 154(b) by 340 days.

(21) Appl. No.: 13/557,720

(22) Filed: Jul. 25, 2012

(65) Prior Publication Data

US 2014/0027120 A1 Jan. 30, 2014

(51) Int. Cl.
*E21B 43/26* (2006.01)
*E21B 33/129* (2006.01)

(52) U.S. Cl.
CPC ..... *E21B 43/26* (2013.01); *E21B 33/1291* (2013.01)

(58) Field of Classification Search
USPC ..... 166/308.1, 177.5, 101, 271, 381, 383
See application file for complete search history.

(56) References Cited

U.S. PATENT DOCUMENTS

| | | | | |
|---|---|---|---|---|
| 2,906,344 | A | 9/1959 | Clark et al. | |
| 3,659,647 | A | 5/1972 | Brown | |
| 3,993,128 | A | 11/1976 | Braddick | |
| 3,999,605 | A | 12/1976 | Braddick | |
| 4,018,272 | A | 4/1977 | Brown et al. | |
| 4,429,741 | A | 2/1984 | Hyland | |
| 4,671,354 | A | 6/1987 | Henderson | |
| 5,146,994 | A | 9/1992 | Pleasants et al. | |
| 5,295,393 | A * | 3/1994 | Thiercelin | 73/152.51 |
| 5,906,240 | A | 5/1999 | Kilgore et al. | |
| 6,176,313 | B1 * | 1/2001 | Coenen et al. | 166/280.1 |
| 7,225,872 | B2 | 6/2007 | Zupanick | |
| 7,814,978 | B2 | 10/2010 | Steele et al. | |
| 7,828,063 | B2 | 11/2010 | Olsen et al. | |
| 2005/0061508 | A1 * | 3/2005 | Surjaatmadja | 166/306 |
| 2008/0142219 | A1 | 6/2008 | Steele et al. | |
| 2011/0088891 | A1 | 4/2011 | Stout | |
| 2011/0139456 | A1 | 6/2011 | Montgomery | |
| 2011/0146995 | A1 * | 6/2011 | Lewis et al. | 166/308.1 |
| 2011/0209868 | A1 | 9/2011 | Dusterhoft et al. | |

FOREIGN PATENT DOCUMENTS

| | | |
|---|---|---|
| CA | 1208544 | 7/1986 |
| CA | 2721369 | 10/2009 |
| GB | 2225601 | 6/1990 |

* cited by examiner

*Primary Examiner* — David Bagnell
*Assistant Examiner* — Taras P Bemko
(74) *Attorney, Agent, or Firm* — Stephen M. De Klerk

(57) ABSTRACT

A method of treating a consolidated formation having a wellbore therein. Tubing including a stress relieving tool is provided in the wellbore. An interval in the wellbore wherein the stress relieving tool is located is isolated. The stress relieving tool is actuated to apply mechanical force radially to an uncased inner diameter surface of the wellbore for providing a reduced stress zone of the formation. Fluid pressure is increased in the wellbore to fracture the formation within the reduced stress zone.

9 Claims, 12 Drawing Sheets

METHOD AND APPARATUS FOR HYDRAULIC FRACTURING

FIELD

The present disclosure relates generally to hydraulic fracturing. More particularly, the present disclosure relates to a method and apparatus for hydraulic fracturing.

BACKGROUND

Production intervals of a wellbore may be uncased to expose porosity and facilitate inflow of hydrocarbon to the wellbore. Hydraulic fracturing may be used to extend fractures from the wellbore into the surrounding formation, facilitating inflow of hydrocarbons. Hydraulic fracturing may have particular use in consolidated reservoirs, where porosity may be decreased relative to other reservoirs. The online Schlumberger oilfield glossary defines "consolidated" as follows: "1. adj. [Geology]: Pertaining to sediments that have been compacted and cemented to the degree that they become coherent, relatively solid rock. Typical consequences of consolidation include an increase in density and acoustic velocity, and a decrease in porosity."

A straddle packer system is a retrievable system run on coil or standard tubing. Mechanically and hydraulically deployed packers are run in to the wellbore to isolate an interval between two packers. A ported burst sub may be present within the interval. A fracture is initiated within the interval.

A stack frac system uses several pairs of packers to isolate several intervals. A ball drop or dart drop sub is placed between pairs of packers. The packers are set prior to hydraulic fracturing, and balls are dropped one at a time to open frac port subs to initiate and propagate each isolated interval.

A drawback of the straddle packer system and the stack frac system is that a fracture may be initiated at a packer, or may jump past a packer, resulting in loss of isolation of an interval. Once isolation is lost, a fracture in a selected interval will be in communication with a subsequent interval, complicating or preventing initiation of a fracture in the subsequent interval.

The above methods facilitate fractures and propagation of an area of the wellbore, but loss of isolation between intervals may leave a portion of the wellbore without fractures, which may result in lowered production of hydrocarbons from the formation.

It is, therefore, desirable to provide a method of fracturing in an interval between packers that does not result in loss of isolation of the interval.

SUMMARY

It is an object of the present disclosure to obviate or mitigate at least one disadvantage of previous methods for hydraulic fracturing.

In a first aspect, the present disclosure provides a method of treating a consolidated formation having a wellbore therein. Tubing including a stress relieving tool is provided in the wellbore. An interval in the wellbore wherein the stress relieving tool is located is isolated. The stress relieving tool is actuated to apply mechanical force radially to an uncased surface of the wellbore for providing a reduced stress zone of the formation. Fluid pressure is increased in the wellbore to fracture the formation within the reduced stress zone.

In a further aspect, the present disclosure provides a method of treating a consolidated formation having a wellbore therein. The method includes providing tubing in the wellbore, the tubing including a stress relieving tool; isolating an interval in the wellbore wherein the stress relieving tool is within the interval; actuating the stress relieving tool to apply mechanical force radially to an uncased surface of the wellbore, thereby non-sealingly engaging the surface for providing a reduced stress zone of the formation; and increasing fluid pressure in the wellbore to a fracturing pressure to fracture the formation within the reduced stress zone.

In an embodiment, the tubing includes a pair of packers, the stress relieving tool is located between the pair of packers, and isolating the interval includes activating the packers for sealingly engaging the surface.

In an embodiment, the method includes flowing fluid into the stress relieving tool at a selected pressure. In an embodiment, the fluid includes a fracturing fluid. In an embodiment, the selected pressure is a lower pressure than the fracturing pressure.

In an embodiment, the method includes flowing fluid into the stress relieving tool at a selected pressure and the fluid includes a gas.

In an embodiment, the method includes producing hydrocarbons from the formation through the tubing following fracturing of the formation In a further aspect, the present disclosure provides a method of treating a consolidated formation having a wellbore therein. The method includes providing tubing in the wellbore, the tubing including a pair of packers and a stress relieving tool, the stress relieving tool located between the packers; activating the packers to apply a first mechanical force radially to an uncased surface of the wellbore to sealingly engage the surface and isolate an interval of the wellbore; actuating the stress relieving tool to apply a second mechanical force radially to the surface, wherein the second mechanical force is greater than the first mechanical force, for providing a reduced stress zone of the formation at the stress relieving tool; and increasing fluid pressure in the interval to fracture the formation within the reduced stress zone.

In an embodiment, engaging the surface at the second force includes non-sealingly engaging the surface.

In an embodiment, actuating the stress relieving tool includes flowing fluid into the stress relieving tool at a selected pressure. In an embodiment, the fluid includes a fracturing fluid. In an embodiment, the selected pressure is a lower pressure than the fracturing pressure.

In an embodiment, actuating the stress relieving tool includes flowing fluid into the stress relieving tool at a selected pressure and the fluid includes a gas.

In an embodiment, the method further includes producing hydrocarbons from the formation through the tubing following fracturing of the formation.

In a further aspect, the present disclosure provides a stress relieving tool including an elongate tubular having a channel therethrough; a first actuator sleeve positioned on the tubular, the first actuator sleeve axially movable along the tubular and in fluid communication with the channel for advancing the first actuator sleeve along the tubular in a first direction in response to fluid pressure in the channel; a first tapered sleeve of decreasing outer diameter in the first direction positioned on the tubular in series with the first actuator sleeve and axially movable along the tubular; a second tapered sleeve of increasing outer diameter in the first direction positioned on the tubular in series with the first tapered sleeve; and a c-ring positioned on the tubular between the first and second tapered sleeves. An inner diameter of the c-ring is equal to an outer diameter at a first portion of the first tapered sleeve, and at a second portion of the second tapered sleeve. The first tapered sleeve is advanced in the first direction by the first actuator sleeve when the first actuator sleeve is advanced in the first direction. The c-ring is urged radially outward when the first tapered sleeve is advanced underneath the c-ring.

In an embodiment, the stress reliving tool includes a protrusion extending from the c-ring along an axial extent of the c-ring less than the axial extent of the surface area the c-ring, for concentrating application of force radially outward by the c-ring to a smaller surface area. In an embodiment, the protrusion extends from the c-ring along a radial extent of the c-ring less than the radial extent of the surface area of c-ring, for concentrating application of force radially outward by the c-ring to a smaller surface area.

In an embodiment, the second tapered sleeve is anchored to the tubular to remain immobile relative to the first tapered sleeve.

In an embodiment, the stress reliving tool includes a second actuator sleeve positioned on the tubular in series with the second tapered sleeve and axially opposed from the first tapered sleeve, the second actuator sleeve axially movable along the tubular and in fluid communication with the channel for advancing the second actuator sleeve along the tubular in a second direction in response to fluid pressure in the channel, the second direction axially opposed to the first direction. The second tapered sleeve is advanced in the second direction by the second actuator sleeve when the second actuator sleeve is advanced in the second direction, and the c-ring is urged radially outward when the second tapered sleeve is advanced underneath the c-ring.

In a further aspect, the present disclosure provides a stress relieving tool including an elongate tubular having a channel therethrough; a first actuator sleeve positioned on the tubular, the first actuator sleeve axially movable along the tubular and in fluid communication with the channel for advancing the first actuator sleeve along the tubular in a first direction in response to fluid pressure in the channel; a first tapered sleeve of decreasing outer diameter in the first direction positioned on the tubular in series with the first actuator sleeve and axially movable along the tubular; a second tapered sleeve of increasing outer diameter in the first direction positioned on the tubular in series with the first tapered sleeve; a first stress pad positioned on the tubular between the first and second tapered sleeves; and a second stress pad positioned on the tubular between the first and second tapered sleeves, the second stress pad radially balanced with the first stress pad. The first tapered sleeve is advanced in the first direction by the first actuator sleeve when the first actuator sleeve is advanced in the first direction. The first stress pad and the second stress pad are urged radially outward from a retracted position to an actuated position when the first tapered sleeve is advanced underneath the first stress pad and the second stress pad.

In an embodiment, the second tapered sleeve is anchored to the tubular to remain immobile relative to the first tapered sleeve.

In an embodiment, the stress reliving tool further includes a second actuator sleeve positioned on the tubular in series with the second tapered sleeve and axially opposed from the first tapered sleeve, the second actuator sleeve axially movable along the tubular and in fluid communication with the channel for advancing the second actuator sleeve along the tubular in a second direction in response to fluid pressure in the channel, the second direction axially opposed to the first direction. The second tapered sleeve is advanced in the second direction by the second actuator sleeve when the second actuator sleeve is advanced in the second direction, and the first stress pad and the second stress pad are urged radially outward when the second tapered sleeve is advanced underneath the first stress pad.

In an embodiment, the stress reliving tool further includes a first protrusion extending from the first stress pad along an axial extent of the first stress pad less than the axial extent of surface area of the first stress pad, for concentrating application of force radially outward by the first stress pad to a smaller surface area; and a second protrusion extending from the second stress pad along an axial extent of the second stress pad less than the axial extent of surface area of the second stress pad, for concentrating application of force radially outward by the second stress pad to a smaller surface area. In an embodiment, the first protrusion extends from first stress pad along a radial extent of the first stress pad less than the radial extent of the surface area of first stress pad, for concentrating application of force radially outward by the first stress pad to a smaller surface area; and the second protrusion extends from second stress pad along a radial extent of the second stress pad less than the radial extent of the surface area of second stress pad, for concentrating application of force radially outward by the second stress pad to a smaller surface area.

In an embodiment, the stress reliving tool further includes a cage positioned about the first stress pad and the second stress pad and anchored to the tubular for defining a maximum extent of actuation of the first and second stress pads.

In an embodiment, the first and second stress pads together cover at least half of the radial extent of the stress relieving tool when in the retracted position. In an embodiment, the first and second stress pads together cover substantially the entire radial extent of the stress relieving tool when in the retracted position.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached figures in which like reference numerals refer to like elements.

DETAILED DESCRIPTION

Generally, the present disclosure provides a method and apparatus for hydraulically fracturing a formation. The method and apparatus facilitate fracturing the formation within an isolated interval of a wellbore at a selected axial position along the wellbore within the interval.

Stress Relieving Tool

Figure 1:
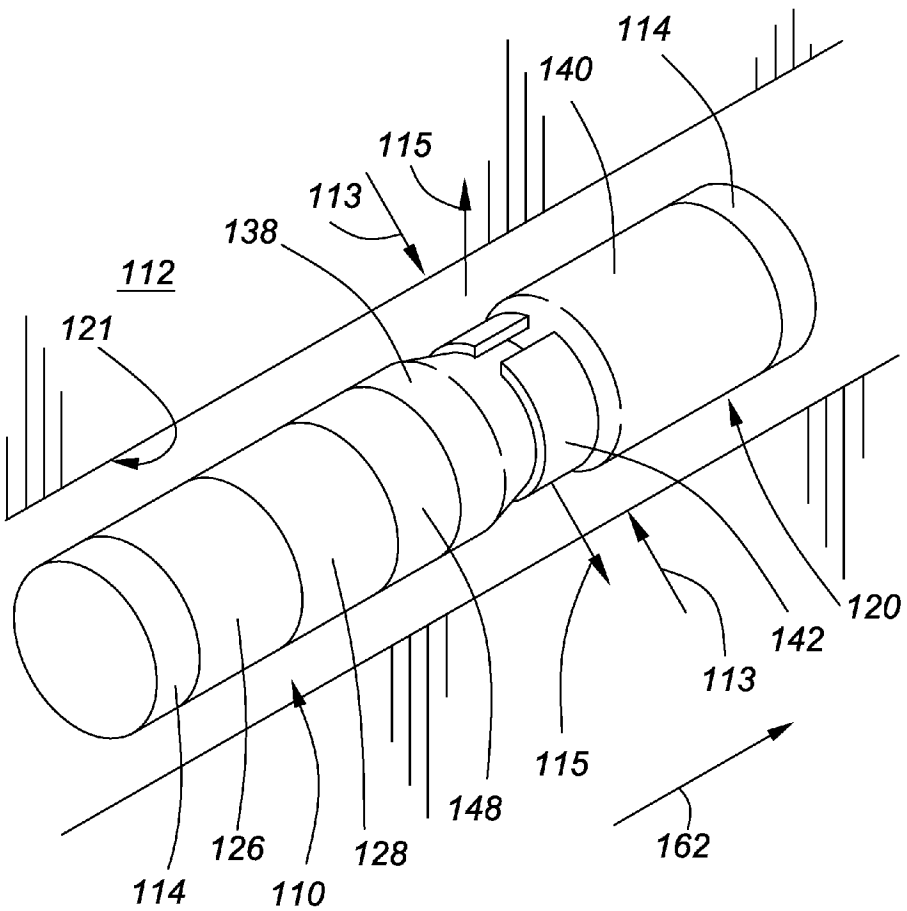
FIG. 1 is a perspective view of a stress relieving tool.

FIG. 1 is a perspective view of a stress relieving tool 120. The stress relieving tool 120 is located in a wellbore 110 within a consolidated formation 112 and is connected to tubing 114. The tubing 114 may for example include connected joints of tubing, coiled tubing, or both. The wellbore 110 is at least partially uncased, and may for example be cemented in locations where it is uncased.

Figure 2:
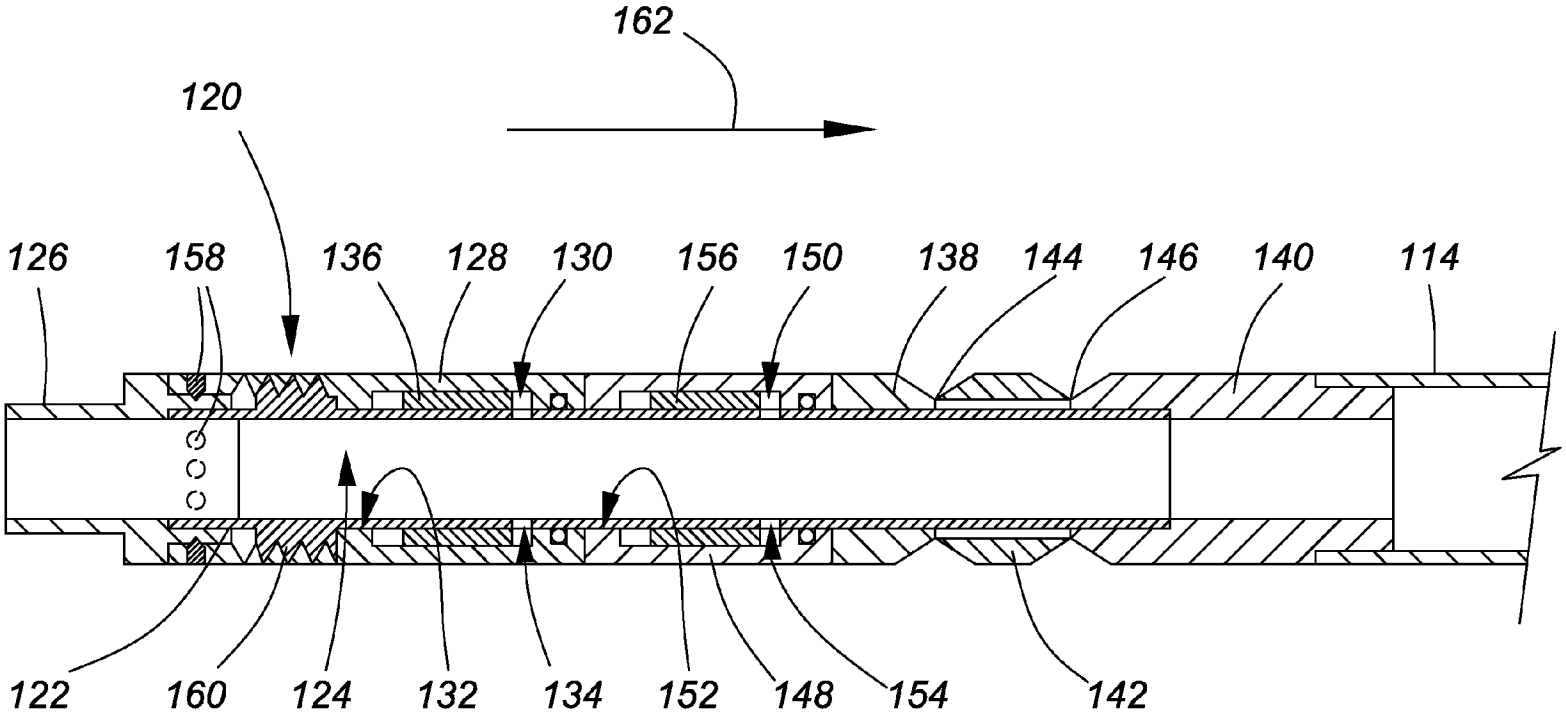
FIG. 2 is a cross-sectional elevation view of the stress relieving tool of FIG. 1.

FIG. 2 is a cross-sectional elevation view of the stress relieving tool 120.

Figure 3:
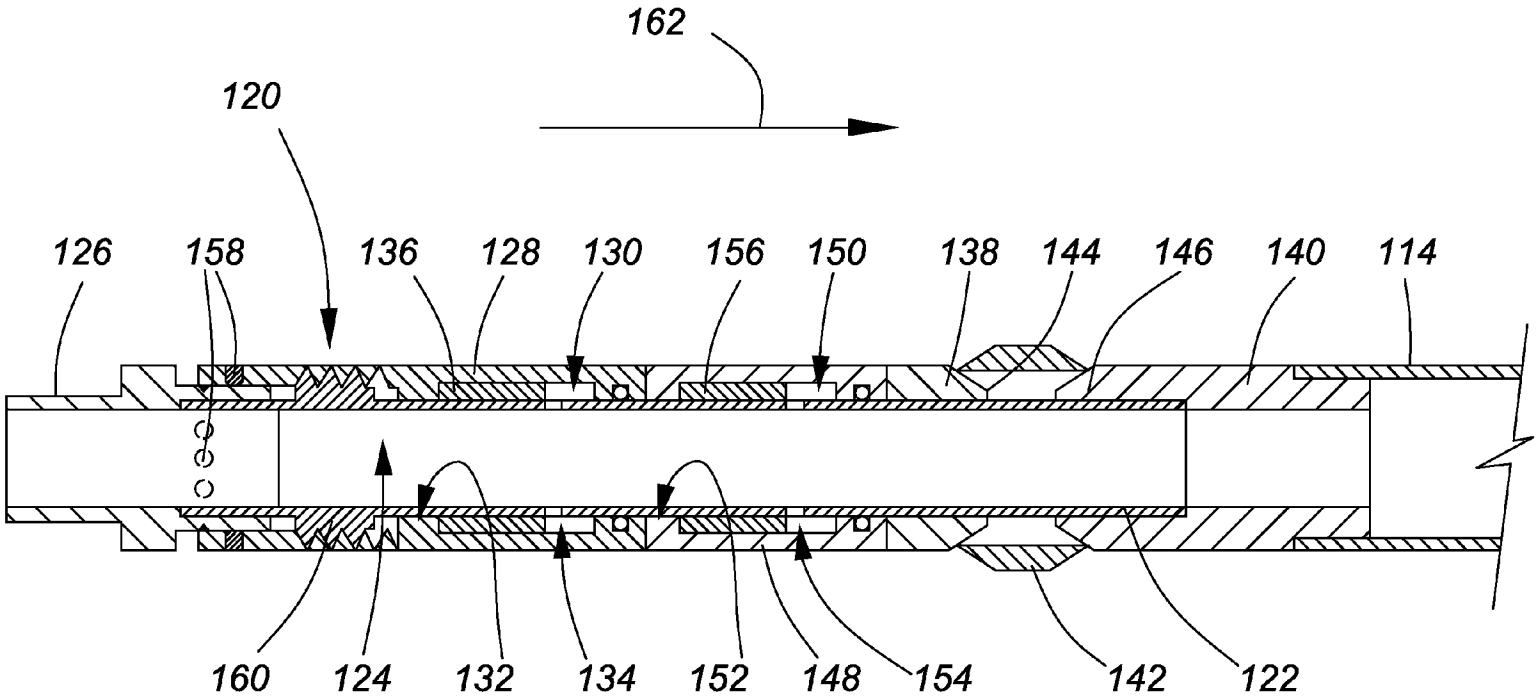
FIG. 3 is a cross-sectional elevation view of the stress relieving tool of FIG. 1 when actuated.

FIG. 3 is a cross-sectional elevation detail view of the stress relieving tool 120 when actuated. The stress relieving tool 120 includes a tubular 122 with an axial channel 124 therethrough. An attachment sub 126 is connected to the tubular 122. The attachment sub 126 may be connected to the tubing 114. Connections between the attachment sub 126 and the tubular 122, and between the attachment sub 126 and the tubing 114 may be threaded connections.

A first actuator sleeve 128 is positioned on the tubular 122 and is axially movable along the tubular 122. A first radial channel 130 is defined on an inner diameter surface 132 of the first actuator sleeve 128. A first aperture 134 in the tubular 122 provides fluid communication between the axial channel 124 and the first radial channel 130. A first piston sub 136 is connected to the tubular 122 (for example by a threaded connection) and positioned between the tubular 122 and the first actuator sleeve 128.

A first tapered sleeve 138 is positioned on the tubular 122 in series with the first actuator sleeve 128. The first actuator sleeve 128 is shown in series with the first tapered sleeve 138 with a second actuator sleeve 148 intermediate the first actuator sleeve 128 and the first tapered sleeve 138. However, the first actuator sleeve 128 could also be directly in series with the first tapered sleeve 138, or of unitary construction with the first tapered sleeve 138. The first tapered sleeve 138 is axially movable along the tubular 122. A second tapered sleeve 140 is positioned on the tubular 122 in series with the first tapered sleeve 138. The second tapered sleeve 140 is connected to the tubular 122 and may be connected to the tubing 114. The second tapered sleeve 140 is immobile relative to the tubular 122, and may for example be connected to the tubular 122 by a threaded connection. The first tapered sleeve 138 has a decreasing outer diameter from the first actuator sleeve 128 to the second tapered sleeve 140 (in a direction 162). The second tapered sleeve 140 has an increasing outer diameter from the first tapered sleeve 138 to the tubing 114 (in the direction 162).

A c-ring 142 is positioned on the tubular 122 and between the first tapered sleeve 138 and the second tapered sleeve 140. The c-ring 142 may be positioned on the first tapered sleeve 138, the second tapered sleeve 140, or both. An inner diameter of the c-ring 142 is substantially equal to an outer diameter at a first portion 144 of the first tapered sleeve 138 and to an outer diameter at a second portion 146 of the second tapered sleeve 140. The first portion 144 and the second portion 146 are portions of the first tapered sleeve 138 and second tapered sleeve 140, respectively, that have an outer diameter less than the maximum outer diameter of the first tapered sleeve 138 and second tapered sleeve 140. For example, the first portion 144 and the second portion 146 may be present substantially at midpoints of the first tapered sleeve 138 and second tapered sleeve 140, respectively.

In an embodiment, a second actuator sleeve 148 is positioned on the tubular 122 in series with the first actuator sleeve 128. The second actuator sleeve 148 is axially movable along the tubular 122, and may be connected to the first actuator sleeve 128, for example by a threaded connection. A second radial channel 150 is defined on an inner diameter surface 152 of the second actuator sleeve 148. A second aperture 154 in the tubular 122 provides fluid communication between the axial channel 124 and the second radial channel 150. A second piston sub 156 is connected to the tubular 122 and positioned between the tubular 122 and the second actuator sleeve 148. The second piston sub 156 is connected to the tubular 122, for example by a threaded connection. The second actuator sleeve 148 facilitates application of greater force to the first tapered sleeve 138 at a given fluid pressure in the axial channel 124 than would be the case with only the first actuator sleeve 128.

In an embodiment, shear pins 158 anchor the second actuator sleeve 148 or the first actuator sleeve 128 to the attachment sub 126. In embodiments lacking the second actuator sleeve 148, the shear pins 158 may anchor the first actuator sleeve 128 to the attachment sub 126.

In an embodiment, a ratchet 160 is positioned between the first actuator sleeve 128 and the tubular 122. The ratchet 160 allows the first actuator sleeve 128 to move axially along the tubular 122 toward the first tapered sleeve 138 but not toward the attachment sub 126 (in the direction 162).

Operation

When fluid is provided within the axial channel 124, the fluid will flow through the first aperture 134 into the first radial channel 130. Fluid pressure within the radial channel 130 will urge the first actuator sleeve 128 away from the first piston sub 136. When the fluid pressure within the radial channel 130 reaches a threshold value, the shear pins 158 break and the first actuator sleeve 128 advances along the tubular 122 in the axial direction 162.

When the first actuator sleeve 128 advances in the axial direction 162, the first tapered sleeve 138 is forced to advance along the tubular 122 in the axial direction 162. The first tapered sleeve 138 will advance into the c-ring 142 beyond the first portion 144, forcing the c-ring 142 against the second tapered sleeve 140 beyond the second portion 146. As a result, the c-ring 142 is forced radially outward.

In an embodiment, the first tapered sleeve 138 may be integrally constructed with the first actuator sleeve 128, with the second actuator sleeve 148, or both, in which case fluid flow within the radial channel 130, the radial channel 150, or both, will directly advance the first tapered sleeve 138 in an axial direction 162.

The c-ring 142 may apply a mechanical force 115 against an uncased surface 121 of the wellbore 110 at the axial position of the wellbore 110 where the stress relieving tool 120 is located. The axial position where the c-ring 142 is located is an uncased portion of the wellbore 110, although casing cement may be present on the surface 121 at the axial position of the c-ring 142. The c-ring 142 non-sealingly presses against the surface 121, applying the mechanical force 115 to the surface 121, which counteracts at least a portion of a stress force 113 which has resulted from drilling the wellbore 110. Counteracting at least a portion of the stress force 113 results in a reduced stress portion of the formation 112 at the axial position of the stress relieving tool 120.

The surface 121 is on the inner diameter of the wellbore 110. In an embodiment, the radial contact area between the c-ring 142 and the surface 121 may be radially substantially around the entire outer diameter of the c-ring 142 and the inner diameter of the wellbore 110 (excluding the break in the c-ring 142), or may be radially only around a portion thereof.

A greater radial extent of the contact area may facilitate creation of the reduced stress portion of the formation 112.

Figure 4:
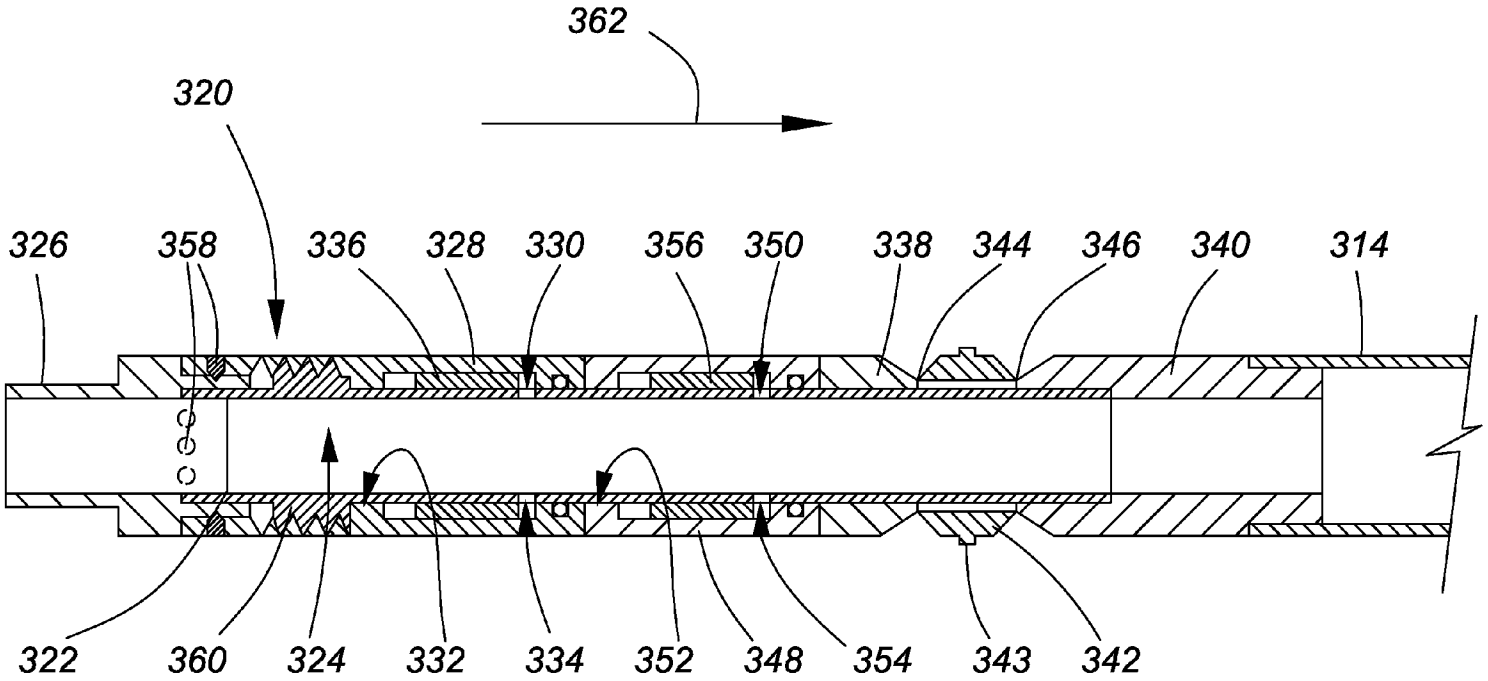
FIG. 4 is a cross-sectional elevation view of a stress relieving tool when actuated.

FIG. 4 is a cross-sectional elevation view of a stress relieving tool 320 when actuated. A protrusion 343 extends from the c-ring 342 along an axial extent of the c-ring 342 less than the axial extent of the surface area of c-ring 342. The protrusion 343 reduces the axial extent of the contact area between the c-ring 342 and a surface with which the c-ring 342 is in contact. The reduced axial contact area facilitates application of the mechanical force 115 to the surface 121 over a smaller area axially, while maintaining the radial extent of the contact area.

In an embodiment, the protrusion 343 may extend from the c-ring along a radial extent of the c-ring 342 less than the radial extent of the surface area of c-ring 342, reducing the radial extent of the contact area between the c-ring 342 and a surface with which the c-ring 342 is in contact. The reduced radial contact area facilitates application of the mechanical force 115 to the surface 121 over a smaller area radially, while maintaining the axial extent of the contact area.

Method of Fracturing a Formation

Figure 5:
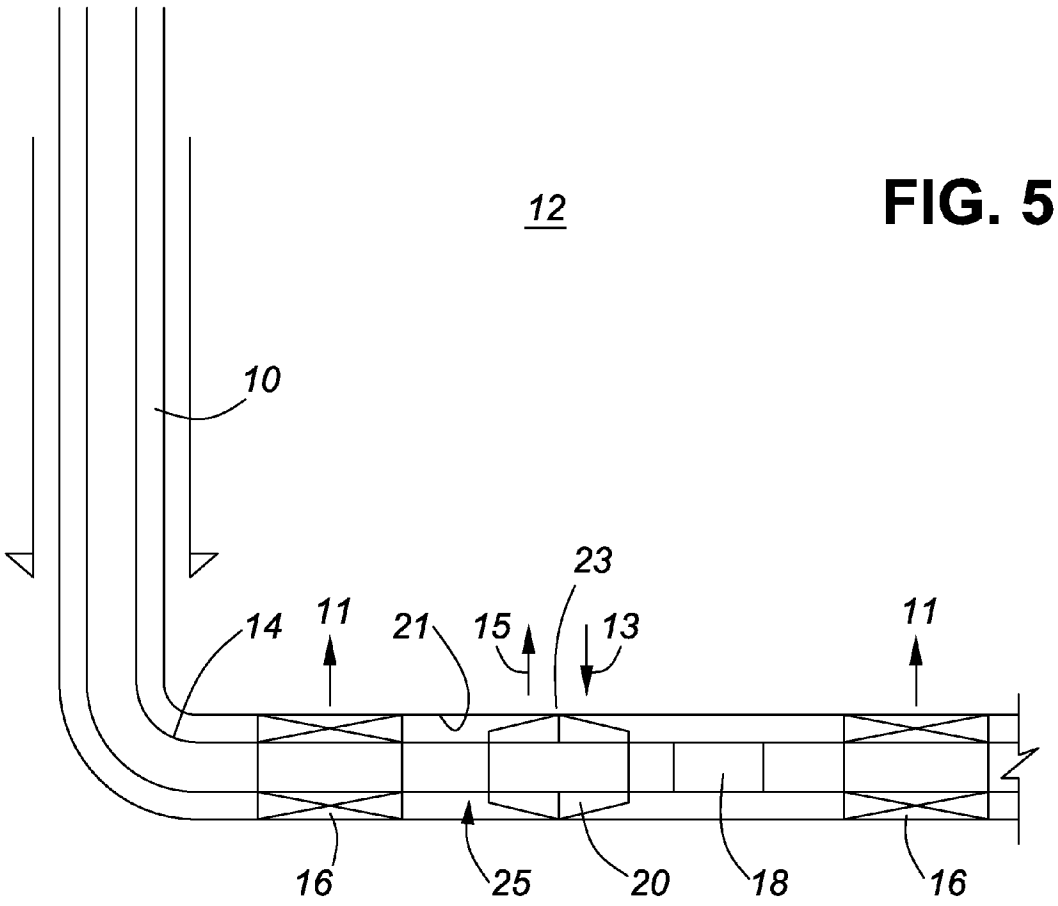
FIG. 5 is a cross-sectional elevation view of a wellbore with tubing including a stress relieving tool.

FIG. 5 is a cross-sectional elevation view of a wellbore 10 in a consolidated formation 12. The wellbore 10 is at least partially uncased. Stress resulting from drilling through the formation 12 provides a stress force 13 which strengthens the formation 12. Tubing 14 is present in the wellbore 10. The tubing 14 includes a pair of packers 16, a fracturing tool 18, and a stress relieving tool 20. The fracturing tool 18 may for example be a frac sleeve tool, a frac port tool, or other tool for delivering fluid to the wellbore 10 to fracture the formation 12.

The packers 16 are activated to apply a first mechanical force 11 radially to an surface 21 of the wellbore 10. The surface 21 is on the inner diameter of the wellbore 10. By application of the first mechanical force 11, the packers 16 sealingly engage the surface 21 and isolate an interval 25 of the wellbore 10.

The stress relieving tool 20 within the interval 25 is actuated to apply a second mechanical force 15 radially to the surface 21. As discussed above with reference to the stress relieving tool 120, the second mechanical force 15 may be extend radially from substantially an entire outer diameter of the stress relieving tool 20 towards the inner diameter of the wellbore 10, or radially around only a portion of the stress relieving tool 20 and wellbore 10. The second mechanical force 15 has a greater magnitude than the first mechanical force 11. The second mechanical force 15 counteracts at least a portion of the stress force 13, resulting in a reduced stress zone 23 of the formation 12. The reduced stress zone 23 includes the axial position in the wellbore 10 of the stress relieving tool 20.

The reduced stress zone 23 may fracture more easily than other portions of the formation 12 along the wellbore 10. The reduced stress zone 23 may fracture more easily than portions of the formation 12 at the packers 16, as the second mechanical force 15 applied to the surface 21 by the stress relieving tool 20 is greater than first mechanical force 11 applied to the surface 21 by the packers 16.

Fracturing fluid is provided to the wellbore 10 from the fracturing tool 18. Hydraulic pressure in the wellbore 10 is increased to a fracturing pressure, fracturing the formation 12 within the reduced stress zone 23.

The stress relieving tool 20 may be uphole or downhole from the fracturing tool 18 as long as the stress relieving tool 20 is located in the interval 25 to be fractured. If fracturing is desired at a selected axial position of the wellbore 10 within the interval 25, the stress relieving tool 20 may be located at the selected axial position.

In an embodiment, the second mechanical force 15 is applied to non-sealingly engage the surface 21.

In an embodiment, the second mechanical force 15 is applied radially to the surface 21 in a plurality of opposing directions. In an embodiment, the mechanical force 15 is applied radially to the surface 21 along substantially the entire inner diameter the wellbore 10.

In an embodiment, the reduced stress zone 23 is proximate the stress relieving tool 20. In an embodiment, the formation 12 is fractured proximate the stress relieving tool 20.

In an embodiment, the tubing 14 may be production tubing for both fracturing and production without repositioning the stress relieving tool 20 or otherwise pulling the tubing 14 from the wellbore 10.

In an embodiment, hydraulic lines may be shared between the stress relieving tool 20 and the packers 16.

In an embodiment, the stress relieving tool 20 are actuated, and the packers 16 are activated, simultaneously.

In an embodiment, the stress relieving tool 20 and the fracturing tool 18 are connected with each other.

Method of Staged Fracturing a Formation

Figure 6:
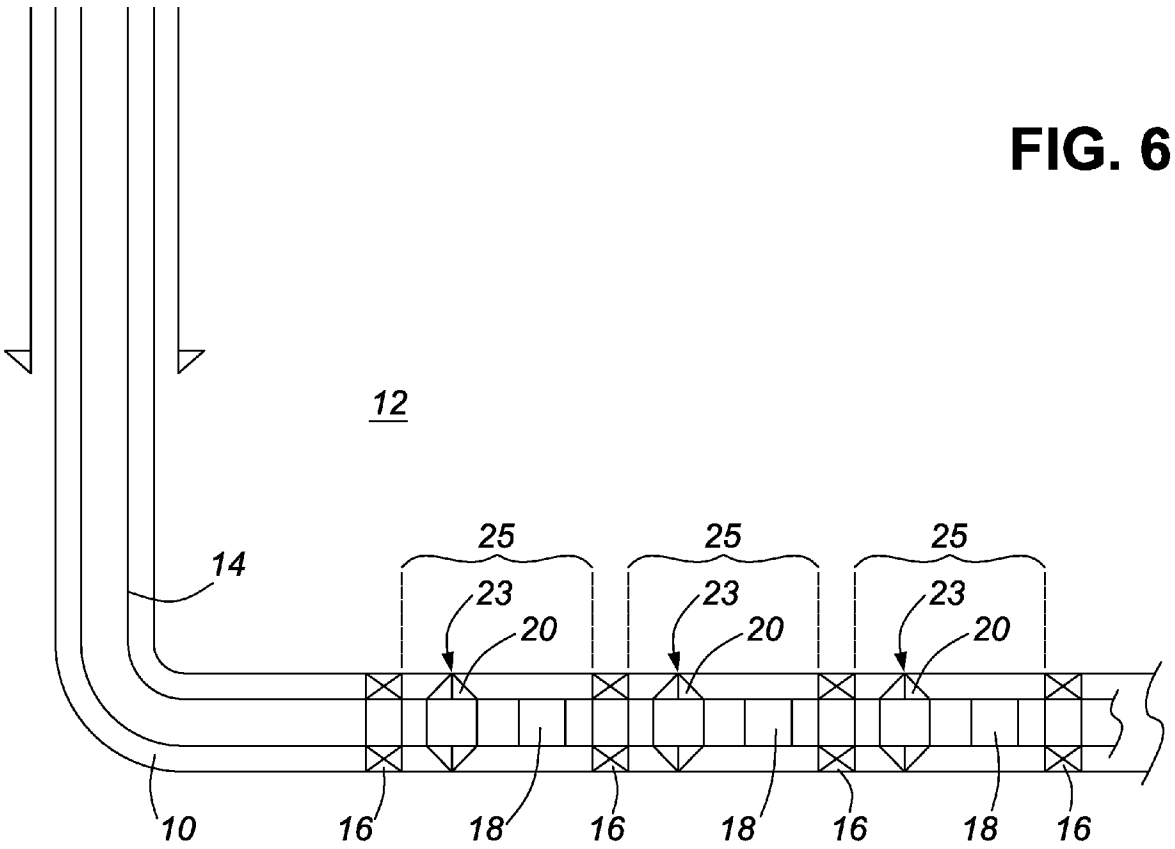
FIG. 6 is a cross-sectional elevation view of a wellbore with tubing including a plurality of stress relieving tools.

FIG. 6 is a cross-sectional elevation view of the wellbore 10 wherein the tubing 14 includes a plurality of pairs of packers 16, fracturing tools 18, and stress relieving tools 20. The fracturing tools 18 may be activated for example by a ball drop or a dart drop, or otherwise.

The packers 16 are activated to apply the first mechanical force 11 radially to the surface 21. By application of the first mechanical force, the packers 16 sealingly engage the surface 21 and isolate intervals 25 of the wellbore 10 and of the formation 12.

The stress relieving tool 20 within each interval 25 is actuated to apply the second mechanical force 15 radially to the surface 21. The second mechanical force 15 has a greater magnitude than the first mechanical force 11. The second mechanical force 15 results in a reduced stress zone 23 of the formation 12. The reduced stress zone 23 includes the axial position in the wellbore 10 of the stress relieving tool 20.

In each interval 25, once the packers 16 are activated and the stress relieving tool 20 is actuated to provide the reduced stress zone 23, fracturing fluid is provided in the interval 25 from the fracturing tools 18. Hydraulic pressure of the fracturing fluid within the interval 25 is increased to a fracturing pressure, and the formation 12 fractures within the reduced stress zone 23.

Stress Relieving Tool with Stress Pads

Figure 7:
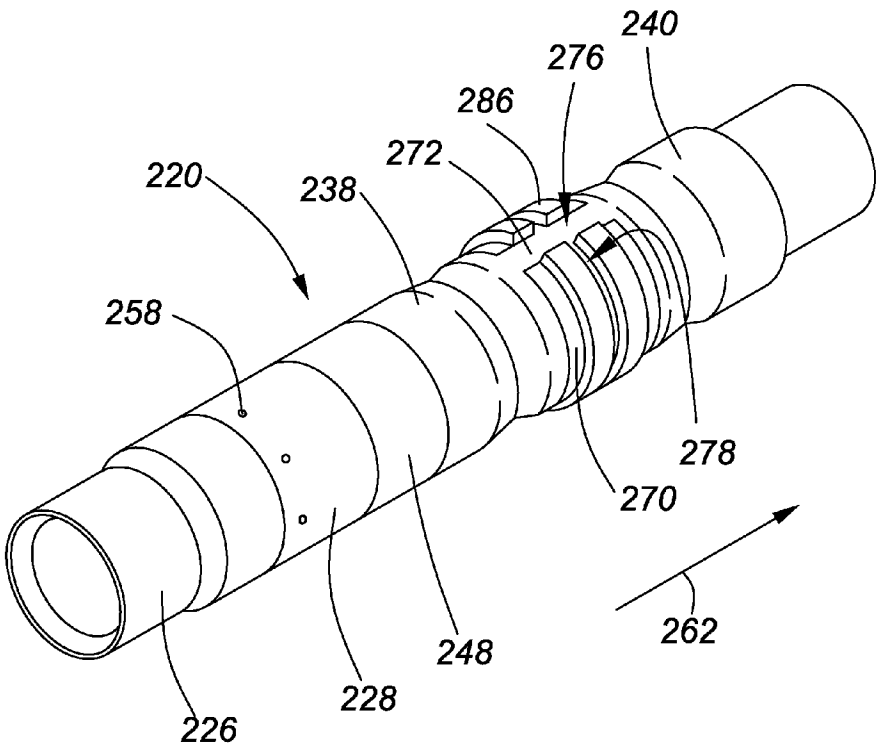
FIG. 7 is a perspective view of a stress relieving tool.

FIG. 7 is a perspective view of a stress relieving tool 220.

Figure 8:
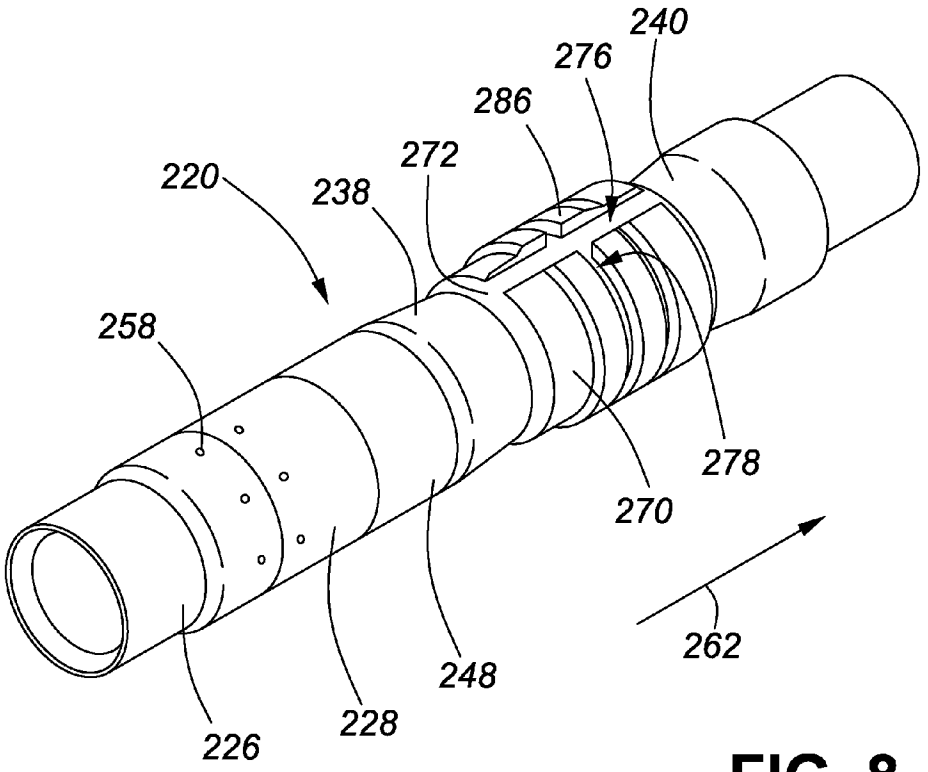
FIG. 8 is a perspective view of the stress relieving tool of FIG. 7 when actuated.

FIG. 8 is a perspective view of the stress relieving tool 220 when actuated.

Figure 9:
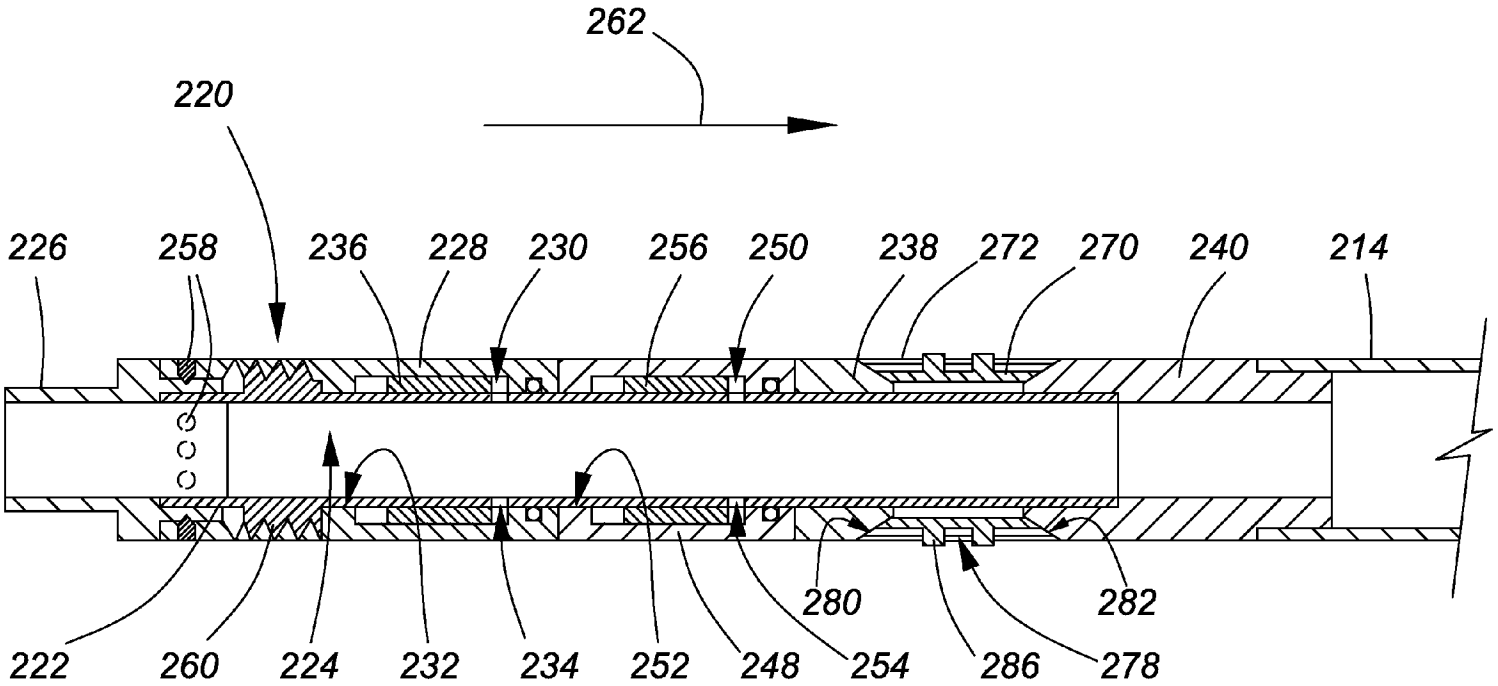
FIG. 9 is a cross-sectional elevation view of the stress relieving tool of FIG. 7.

FIG. 9 is a cross-sectional elevation view of the stress relieving tool 220.

Figure 10:
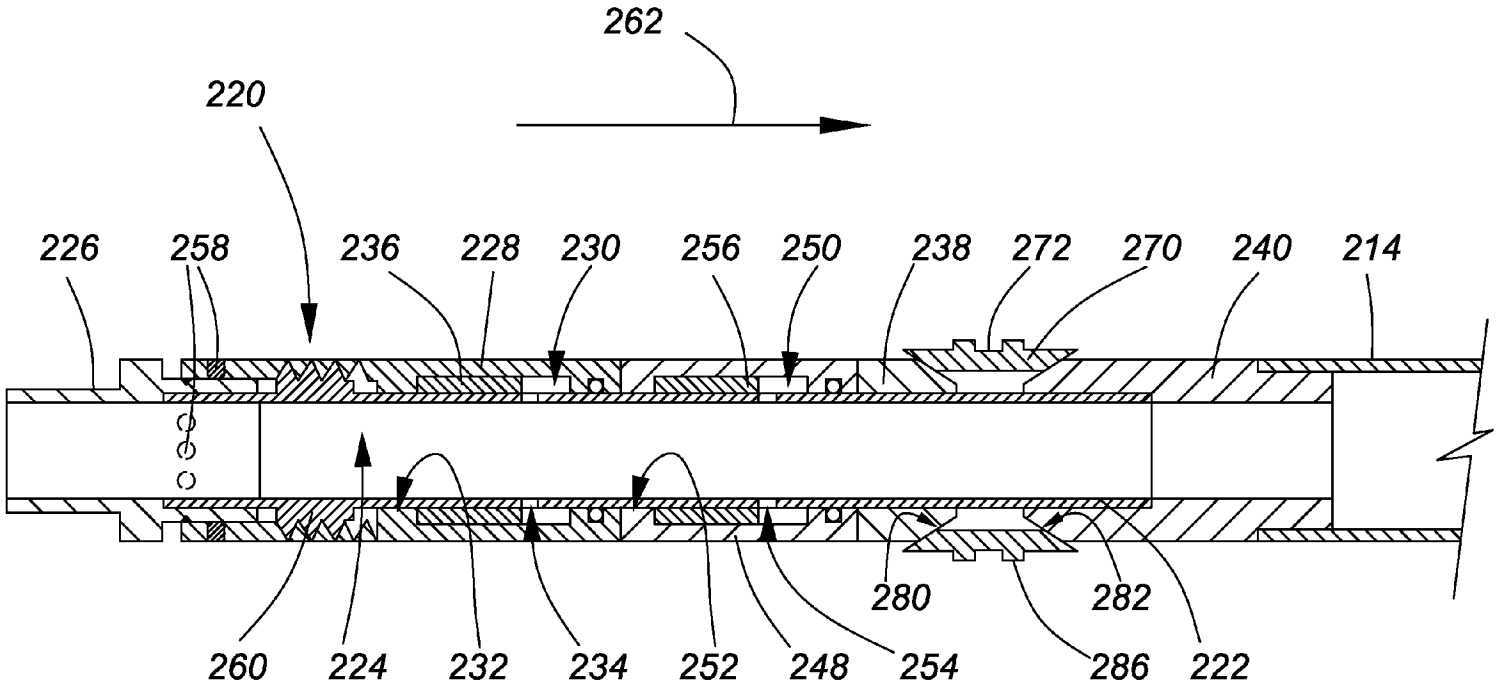
FIG. 10 is a cross-sectional elevation view of the stress relieving tool of FIG. 7 when actuated.

FIG. 10 is a cross-sectional elevation view of the stress relieving tool 220 when actuated.

The stress relieving tool 220 includes three stress pads 270 positioned on the tubular 222. The stress pads are radially movable relative to the tubular 222 when actuated by the first actuator sleeve 228 and second actuator sleeve 248. The stress pads 270 are radially balanced with respect to one another by being radially evenly spaced about the stress relieving tool 220, allowing a mechanical force applied radially outward by the stress pads 270 to be radially balanced. In an embodiment, two stress pads 270 may be used, or four or more stress pads 270 may be used. In embodiments where even numbers of stress pads 270 are used, radially balanced stress pads are radially opposite each other.

In an embodiment, the stress pads 270 may cover at least half of the radial extent of the stress relieving tool 220 when in a retracted position (retracted position shown in FIGS. 7 and 9). In an embodiment, the stress pads 270 may cover substantially the entire radial extent of the stress relieving tool 220 when in the retracted position. A greater radial extent of the contact area may facilitate creation of a reduced stress portion in the formation 212.

A cage 272 is positioned on the stress pads 270 to retain the stress pads 270 in proximity to the tubular 222. The cage 272 is anchored to the tubular 222 and is immobile relative to the tubular 222. A biasing member may be present between the stress pads 270 and the cage 270. The biasing member may for example be a spring or a shear pin. The stress pads 270 are separated from one another by separations 276 extending axially along the tubular 222 between the stress pads 270. A radial groove 278 extends across each stress pad 270. The biasing member may be present in one of the radial grooves 278. The cage 272 is received within the separations 276 and within the radial grooves 278. The cage 272 is positioned to retain the stress pads 270 in a retracted position (as shown in FIGS. 7 and 9). In the retracted position, the stress pads 270 will have a sufficiently narrow cross-sectional profile to be run into a wellbore.

In an embodiment, a first tapered surface 280 and a second tapered surface 282 are present on an inner surface of the stress pads 270. The first tapered surface 280 matches the first tapered sleeve 238 and the second tapered surface 282 matches the second tapered sleeve 240.

In an embodiment, a ratchet is positioned between the first tapered sleeve 238 and the tubular 222. The ratchet allows the first tapered sleeve 238 to move axially along the tubular 222 only in the direction 262, which is toward the second tapered sleeve 240 but not toward the first actuator sleeve 230.

Advancement of the first actuation sleeve 228 along the tubular 222 in the axial direction 262 during actuation axially advances the first tapered sleeve 238 along the first tapered surface 280, and the second tapered surface 282 along the second tapered sleeve 240. Thus, advancement of the first actuation sleeve 228 in the direction 262 forces the stress pads 270 radially outward into an actuated position (actuated position shown in FIGS. 8 and 10) to apply force to the surface 221. The stress pads 270 may be urged radially outward until a base of the radial groove 278 abuts the cage 272.

In an embodiment, a protrusion 286 extends from each of the stress pads 270 along an axial extent of the stress pads 270 less than the axial extent of the surface area of stress pads 270. The protrusion 286 reduces the axial extent of the contact area between the stress pads 270 and a surface with which the stress pads 270 are in contact. The reduced contact area facilitates application of the mechanical force 215 to the surface 221 over a smaller area axially, while maintaining the radial extent of the contact area.

In an embodiment, the protrusion 286 may extend from the stress pads 270 along a radial extent of the stress pads 270 less than the radial surface area of the stress pads 270, reducing the radial extent of the contact area between the stress pads 270 and a surface with which the stress pads 270 are in contact. The reduced radial contact area facilitates application of the mechanical force 115 to the surface 121 over a smaller area radially, while maintaining the axial extent of the contact area.

Movable Second Tapered Sleeve

Figure 11:
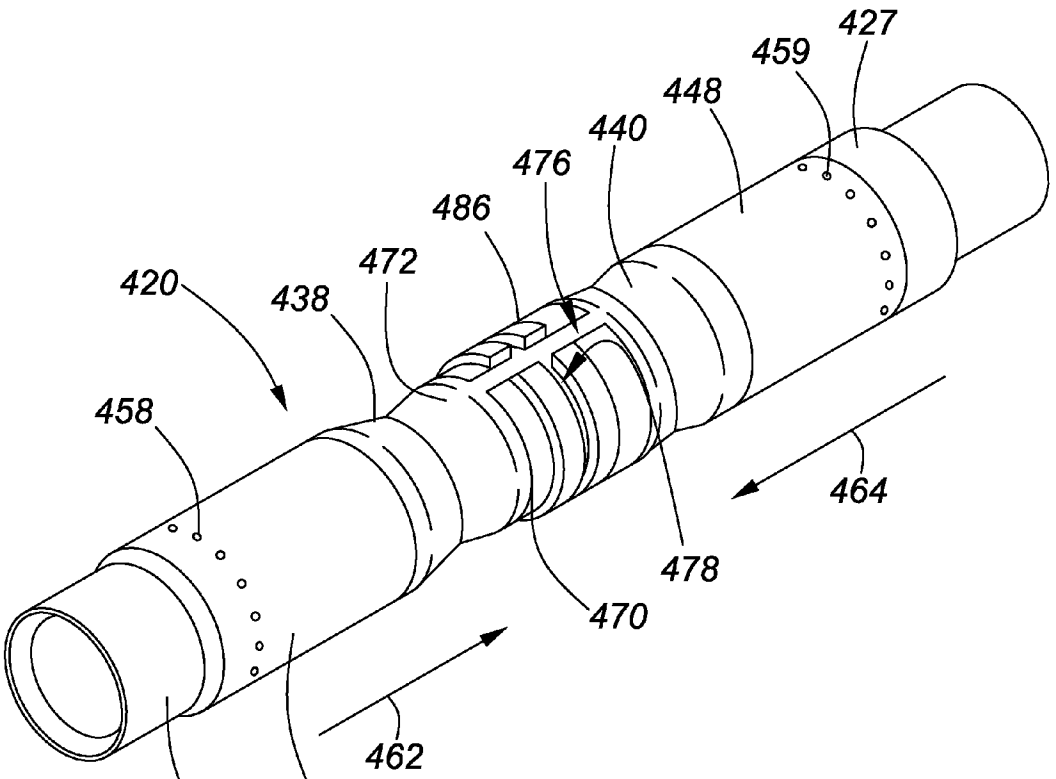
FIG. 11 is a perspective view of a stress relieving tool.

FIG. 11 is a perspective view of a stress relieving tool 420. The second tapered sleeve 440 is axially movable along the tubular 422. The second actuator sleeve 448 is in series with the second tapered sleeve 440. The second actuator sleeve 448 advances in a second axial direction 464 under fluid pressure from the axial channel 424, advancing the second tapered sleeve 440 in the second direction 464 and actuating the stress pads 470. In an embodiment, the second actuator sleeve 448 may be advanced in the second axial direction 464 simultaneously with advancement of the first actuator sleeve 428 in the first axial direction 462. In an embodiment, shear pins 459 anchor the second actuator sleeve 448 to an attachment sub 427.

Figure 12:
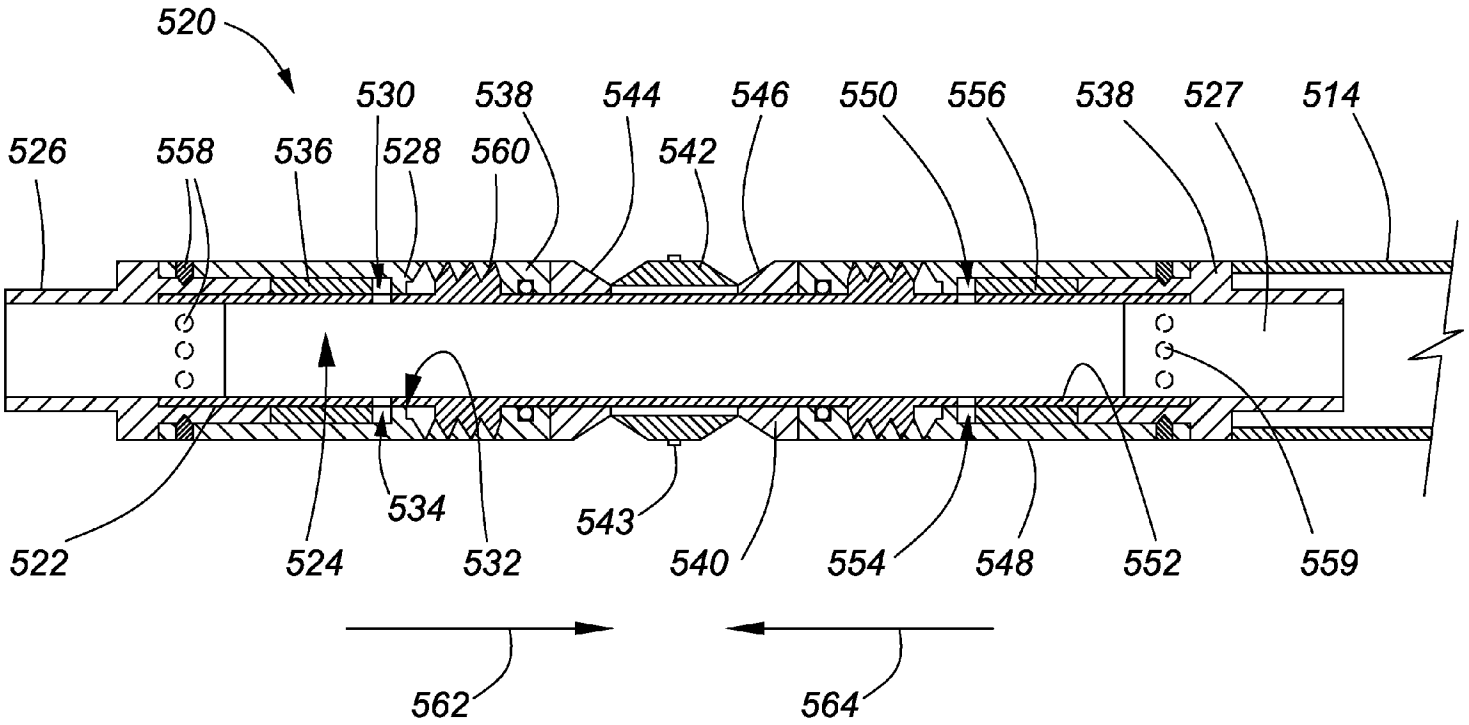
FIG. 12 is a cross-sectional elevation view of a stress relieving tool.

FIG. 12 is a cross-sectional elevation view of a stress relieving tool 520. The c-ring 542 is actuated by advancement of the first tapered sleeve 538 in the first axial direction 562 and advancement of the second tapered sleeve 540 in the second axial direction 564.

Examples Only

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art without departing from the scope, which is defined solely by the claims appended hereto.

What is claimed is:

1. A stress relieving tool comprising:

an elongate tubular having a channel therethrough;

a first actuator sleeve positioned on the tubular, the first actuator sleeve axially movable along the tubular and in fluid communication with the channel for advancing the first actuator sleeve along the tubular in a first direction in response to fluid pressure in the channel;

a first tapered sleeve of decreasing outer diameter in the first direction positioned on the tubular in series with the first actuator sleeve and axially movable along the tubular;

a second tapered sleeve of increasing outer diameter in the first direction positioned on the tubular in series with the first tapered sleeve; and a c-ring positioned on the tubular between the first and second tapered sleeves;

wherein:

an inner diameter of the c-ring is equal to an outer diameter at a first portion of the first tapered sleeve, and at a second portion of the second tapered sleeve;

the first tapered sleeve is advanced in the first direction by the first actuator sleeve when the first actuator sleeve is advanced in the first direction;

the c-ring is urged radially outward when the first tapered sleeve is advanced underneath the c-ring; and the second tapered sleeve is anchored to the tubular to remain immobile relative to the first tapered sleeve.

2. The stress relieving tool of claim 1 further comprising a protrusion extending from the c-ring along an axial extent of the c-ring less than the axial extent of the surface area the c-ring, for concentrating application of force radially outward by the c-ring to a smaller surface area.

3. The stress relieving tool of claim 2, wherein the protrusion extends from the c-ring along a radial extent of the c-ring less than the radial extent of the surface area of c-ring, for concentrating application of force radially outward by the c-ring to a smaller surface area.

4. A stress relieving tool comprising:

an elongate tubular having a channel therethrough;

a first actuator sleeve positioned on the tubular, the first actuator sleeve axially movable along the tubular and in fluid communication with the channel for advancing the first actuator sleeve along the tubular in a first direction in response to fluid pressure in the channel;

a first tapered sleeve of decreasing outer diameter in the first direction positioned on the tubular in series with the first actuator sleeve and axially movable along the tubular;

a second tapered sleeve of increasing outer diameter in the first direction positioned on the tubular in series with the first tapered sleeve;

a first stress pad positioned on the tubular between the first and second tapered sleeves; and a second stress pad positioned on the tubular between the first and second tapered sleeves, the second stress pad radially balanced with the first stress pad;

wherein:

the first tapered sleeve is advanced in the first direction by the first actuator sleeve when the first actuator sleeve is advanced in the first direction;

the first stress pad and the second stress pad are urged radially outward from a retracted position to an actuated position when the first tapered sleeve is advanced underneath the first stress pad and the second stress pad; and the second tapered sleeve is anchored to the tubular to remain immobile relative to the first tapered sleeve.

5. The stress relieving tool of claim 4 further comprising:

a first protrusion extending from the first stress pad along an axial extent of the first stress pad less than the axial extent of the surface area of the first stress pad, for concentrating application of force radially outward by the first stress pad to a smaller surface area; and a second protrusion extending from the second stress pad along an axial extent of the second stress pad less than the axial extent of the surface area of the second stress pad, for concentrating application of force radially outward by the second stress pad to a smaller surface area.

6. The stress relieving tool of claim 5 wherein:

the first protrusion extends from the first stress pad along a radial extent of the first stress pad less than the radial extent of the surface area of first stress pad, for concentrating application of force radially outward by the first stress pad to a smaller surface area; and the second protrusion extends from the second stress pad along a radial extent of the second stress pad less than the radial extent of the surface area of second stress pad, for concentrating application of force radially outward by the second stress pad to a smaller surface area.

7. The stress relieving tool of claim 4 further comprising a cage positioned about the first stress pad and the second stress pad and anchored to the tubular for defining a maximum extent of actuation of the first and second stress pads.

8. The stress relieving tool of claim 4 wherein the first and second stress pads together cover at least half of the radial extent of the stress relieving tool when in the retracted position.

9. The stress relieving tool of claim 8 wherein the first and second stress pads together cover substantially the entire radial extent of the stress relieving tool when in the retracted position.

* * * * *